US005633508A

United States Patent [19]

Schleppenbach

[11] Patent Number: 5,633,508

[45] Date of Patent: May 27, 1997

[54] SECONDARY SHIELDING STRUCTURE

[75] Inventor: Dale J. Schleppenbach, St. Cloud, Minn.

[73] Assignee: Cold Spring Granite Company, Cold Spring, Minn.

[21] Appl. No.: 541,247

[22] Filed: Oct. 12, 1995

[51] Int. Cl.[6] ..... G21F 1/02; G21F 3/04

[52] U.S. Cl. ..... 250/517.1; 250/515.1

[58] Field of Search ..... 250/517.1, 515.1

[56] References Cited

U.S. PATENT DOCUMENTS

| | | | |
|---|---|---|---|
| 3,614,446 | 10/1971 | Leuthold et al. | 250/517.1 |
| 4,321,158 | 3/1982 | Beall et al. | 252/628 |
| 4,500,227 | 2/1985 | Courtois et al. | 405/128 |
| 4,527,066 | 7/1985 | Dyck et al. | 250/507.1 |
| 4,586,849 | 5/1986 | Hastings | 405/128 |
| 4,608,495 | 8/1986 | Jacobson | 250/417.1 |
| 4,712,015 | 12/1987 | Aspden | 250/517.1 |
| 5,241,573 | 8/1993 | Thacker | 376/287 |

FOREIGN PATENT DOCUMENTS

| | | | |
|---|---|---|---|
| 1154921 | 9/1963 | Germany | 250/517.1 |

OTHER PUBLICATIONS

Hookham, C. J., et al., "Long Term Durability Considerations for Nuclear Power Plant Structures," *Long-Term Serviceability of Concrete Structures*, pp. 267–283 (1989). no month.

Kettle, R., et al., "The Influence of Construction Procedures on Abrasion Resistance," *Concrete Durability*, 2:1385–1411 (1987). no month Mather, K. and B., "Reflections on Concrete Durability and on International Conferences on Concrete Durability," 1:1–19 (1987). no month.

Sawan, J., "Cracking Due to Frost Action in Portland Cement Concrete Pavements—A Literature Survey," *Concrete Durability*, 1:781–803 (1987). no month.

*Primary Examiner*—Jack I. Berman

*Attorney, Agent, or Firm*—Merchant, Gould, Smith, Edell, Welter & Schmidt, P.A.

[57] ABSTRACT

The present invention provides a method and construction for shielding a source of radiation. The method includes the step of surrounding the source of radiation with a granite wall. The wall provides a interlocking block construction which prevent the blocks from separating. The wall further includes foundation blocks positioned below a ground surface to stabilize the wall. Additionally, the wall includes cap blocks which have sloped top surfaces to deflect rain water.

10 Claims, 6 Drawing Sheets

SECONDARY SHIELDING STRUCTURE

OBJECT OF THE INVENTION

The present invention relates to radiation attenuation shielding, and in particular to providing a low maintenance, high durability shield for shielding nuclear waste.

BACKGROUND OF THE INVENTION

Nuclear energy has been used as a power source for approximately the last 50 years. The nuclear reactors providing that power have been producing waste since that time. That waste has created significant problems.

There are approximately 110 active nuclear reactors in the United States, each producing an average of 20 metric tons of nuclear waste. A nuclear power facility ordinarily stores this waste in an on-site indoor water pool. However, these facilities are quickly reaching their storage capacity.

By 1998, 32 nuclear reactors will have no more indoor water pool storage capacity. To address this problem, the federal government in 1982 enacted the Nuclear Waste Policy Act which mandated that the federal government accept nuclear waste beginning Jan. 31, 1998. As of today, the federal government does not have a concise definitive plan in place to deal with the nuclear waste it will receive. Indeed, the proposed federal repository site at Yucca Mountain is years behind schedule. Further, because of earthquakes and transportation problems there is no guarantee that the Yucca Mountain facility will ever be completed.

Adding to the problem of excess nuclear waste is the fact that many nuclear power plants are likely to close in the next two decades. When these reactors are closed, the waste at those power plants must also be handled.

The disposal of nuclear waste raises serious questions regarding public safety. The recognized harm (for example, cancer) caused by high levels of radiation exposure have caused a great deal of public concern about radiation from nuclear power plants and about radiation generally. This public concern and other concerns have made it difficult for public utilities to create permanent nuclear waste facilities. For example, permanent facilities may involve storing the nuclear waste below ground level which raises issues related to underground water contamination. Underground facilities are also difficult to monitor and maintain and make retrieving the waste for reprocessing difficult.

To address these problems, many utilities are pressing the federal government to license rugged above-ground containers for either temporary or permanent storage. Rugged above-ground containers are called dry casks, and to date, are only temporary in nature. Dry casks are ordinarily constructed from concrete and steel and are placed on a concrete base. The nuclear waste is then placed in the cask. An example of one such cask is disclosed in U.S. Pat. No. 4,527,066 to Dyek entitled "CONCRETE SHIELDING HOUSING FOR RECEIVING AND STORING A NUCLEAR FUEL ELEMENT CONTAINER." Other casks are available in the prior art as well.

Above-ground storage in casks raise significant public concerns as well. The public concerns are exacerbated by the fact that facilities which were designed to be temporary are quickly becoming considered to be permanent. The concerns include the possible discontinuance of maintenance, sabotage, and difficulties in transportation.

Maintenance of these above-ground casks is critical because of their concrete construction. With proper maintenance, scientists have speculated that concrete used in nuclear applications may have a service life of up to 60 years. See Hookham & Bailey, Long Term Durability Considerations for Nuclear Power Plant Structures 1990.

However, if a facility is permanent, 60 years is a very short time as compared to the long-term toxicity of nuclear waste. Problems associated with concrete structures include cracking and deterioration. These problems are caused in part by freeze/thaw cycling of water in addition to the additional corrosive affects caused by acid rain. As concluded by Hookham and Bailey, without proper maintenance these environmental factors will eventually render a concrete structure unsafe.

When these problems occur, the concrete must be repaired and/or replaced. To properly perform maintenance, the dry cask must be continually monitored so that cracks and erosion can be repaired immediately. The process of continually monitoring and repairing is extremely costly. As budgets are cut back, additional concerns arise because these concrete structures may fall out of repair thereby shorting their useful life. If maintenance is discontinued, the structure would erode thereby compromising its integrity.

Because the potential harm which would be caused by a nuclear radiation leak is so great, facilities must protect against sabotage or attack. Sabotage may take the form of launched projectiles, or direct attack by suicide or truck bombers. Thus, storage facilities must provide a high degree of security.

Safe transportation of nuclear waste is also an issue which must be addressed. The primary issue related to transportation is the public's unwillingness to allow high sources of radiation traveling past homes and exposing people to the radiation. To avoid these problems, nuclear power plants prefer to store waste on site.

Therefore, a need has arisen to prevent the potential harm to the public should maintenance of these temporary facilities cease, or should the temporary casks be compromised. A further need has arisen to make the temporary sites which are becoming permanent safer.

SUMMARY OF THE INVENTION

The present invention provides for a method and construction to shield radiation. The method includes the steps of surrounding a source of radiation with a granite wall.

The wall of the present invention includes a construction not heretofore used with granite. That construction shields a source of radiation being positioned on ground level. The secondary attenuation shield includes a plurality of granite foundation blocks where the granite foundation blocks have a top surface including a first mating portion. The foundation blocks are positioned partially below ground level and are positioned to form a wall. A plurality of block sections having a top and bottom surface where the bottom surface includes a second mating portion cooperative in interfacing with the first mating portion of the foundation blocks are positioned on the foundation blocks so that the foundation blocks and the block sections obstruct the source of radiation. In the preferred embodiment, horizontally adjacent blocks also include cooperative mating portions to interlock horizontally adjacent blocks.

DETAILED DESCRIPTION OF THE PREFERRED EMBODIMENTS

Figure 1:
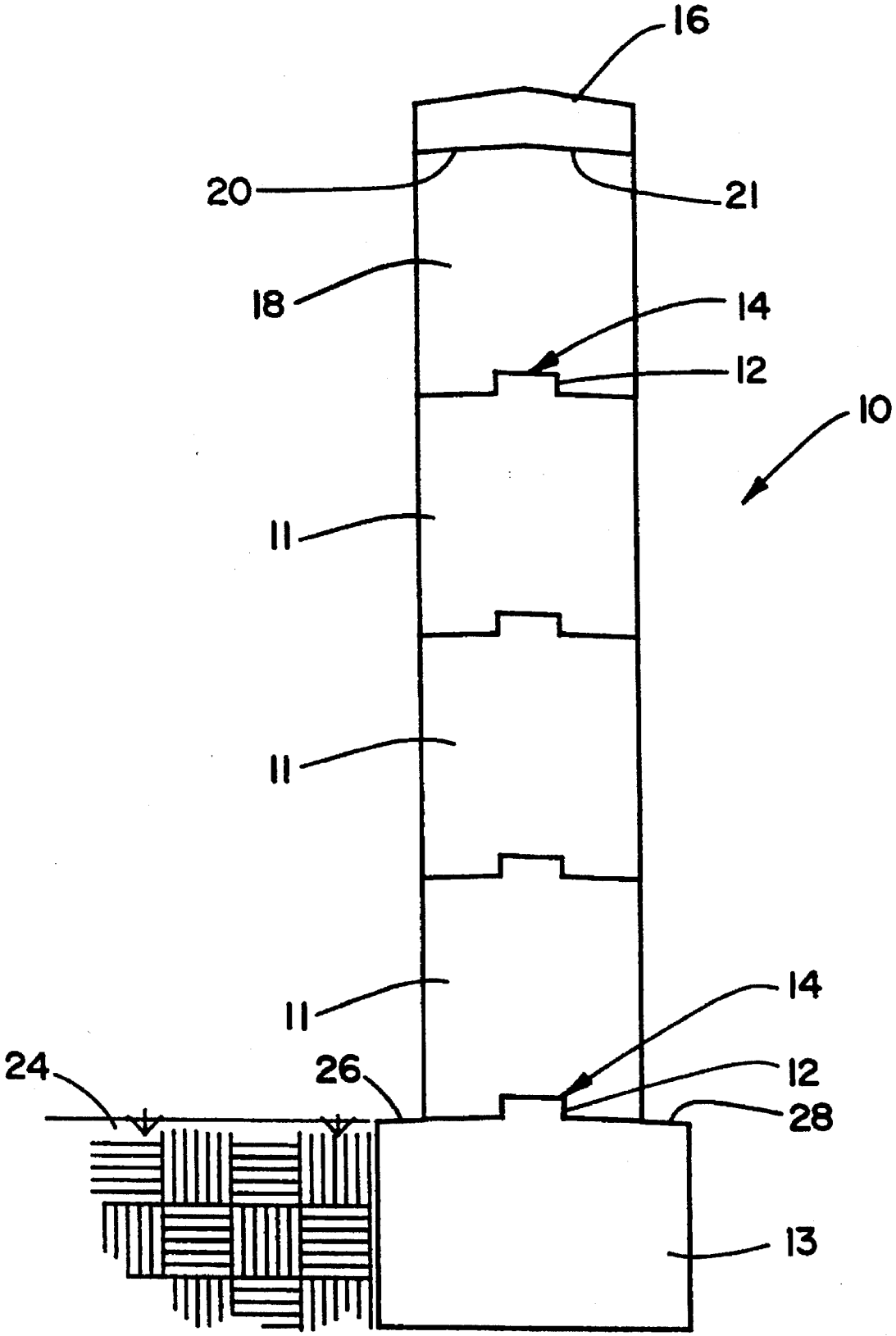
FIG. 1 is a cross-sectional view of the granite radiation attenuation shield of the present invention.

The present invention provides a method of shielding a source of nuclear radiation such as an above-ground, dry nuclear storage cask. The invention provides a granite shielding structure surrounding an above-ground cask containing nuclear waste. The shielding structure includes a construction which minimizes accumulation of water, thereby contributing to an increase in durability.

In shielding radiation, the present invention utilizes previously unknown properties of granite. In particular, it has been found that granite has exceptional radiation attenuation properties. As understood, the principal radiation admitted by spent nuclear fuel contained in dry casks is gamma rays from fission byproducts. These fission byproducts typically come from spent fuel consisting of small uranium pellets. These fission byproducts include $^{137}Cs$ and $^{154,155}Eu$. It has been found that granite significantly attenuates gamma rays whose energy span the likely range of spent fuel. The range of gamma radiation is 76 keV to 1764 keV. Below, are two tables that summarize the gamma attenuation factors and dose reduction factors for the particular granite of the preferred embodiment.

TABLE 1

(Rockville Granite)

| 90% reduction thickness in cm (in.)[1] | Gamma energy = 76 keV | 352 keV | 609 keV | 662 keV | 1120 keV | 1764 keV |
|---|---|---|---|---|---|---|
| Photopeak[2] | 2 (1) | 4 (1.5) | 4 (1.5) | 4 (1.5) | 4 (1.5) | 3 (1.2) |
| Dose rate[3] | 3 (1) | | | 12 (5) | | 6 (2.5) |

TABLE 2

(Rockville Granite)

| Thickness: in inches[1] | Relative Dose |
|---|---|
| 0 | 1 |
| 5 | 0.1 |
| 10 | 0.01 |
| 30 | 0.000001 |
| 60 | $10^{-12}$ |

[1]Thickness uncertainties are typically on the order of 25%.

These photopeak attenuation and dose reduction factors indicate that walls of granite a few feet thick would provide excellent shielding from normal and most accidental radiation leakage. For example, if on one side of a 4 foot × 8 inch thick granite wall, the thickness of the preferred embodiment, there was a 100-year-old unshielded spent nuclear fuel assembly, the dose rate next to the assembly would be approximately 300 rem/hr and would be lethal after a few minutes of exposure time. However, the amount of radiation that would pass through a granite wall of the construction described below and having a thickness of 5 to 10 inches would be only a fraction of that 3 μrem/hr, which is no greater than anywhere else on earth.

The significance of these attenuation properties are multiplied by the extraordinary durability properties of granite. Granite structures have withstood the test of time as evidenced by the remaining existence of castles in Europe which are hundreds of years old. These granite walls include a simple block construction. However, the block construction previously used in these granite structures is not adequate to shield dry casks containing spent nuclear fuel. The granite blocks of the prior art may tend to separate slightly, thereby permitting radiation to escape through the cracks. The block construction also does not provide enough structural integrity to withstand attack, sabotage or earthquakes. The present invention does not allow the structure to separate and has exceptional structural integrity by providing a unique construction which provides significant advantages necessary to protect the dry casks containing the spent nuclear fuel.

Figure 2:
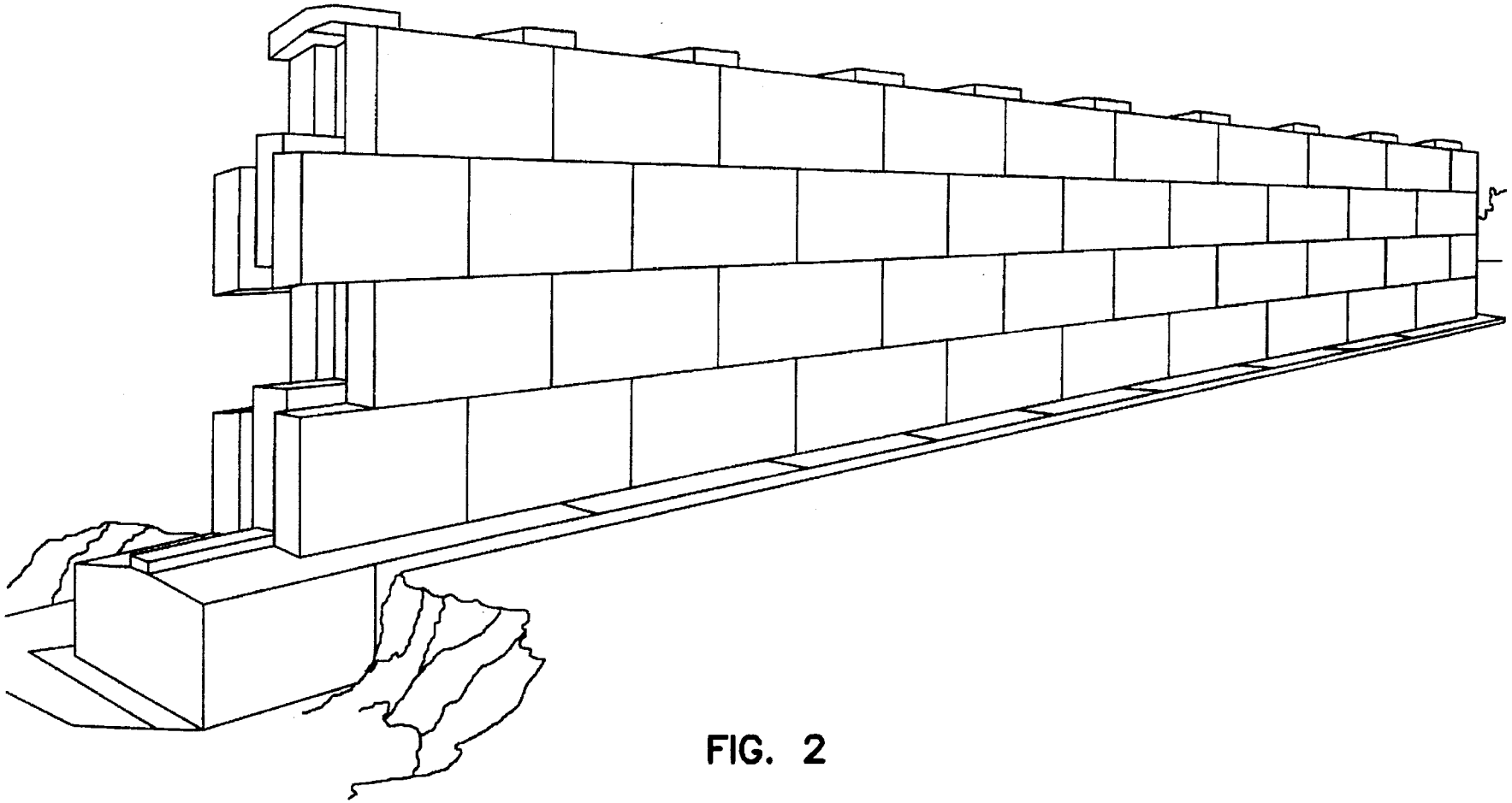
FIG. 2 is a perspective view of a partially constructed attenuation shield of the present invention.
Figure 3A:
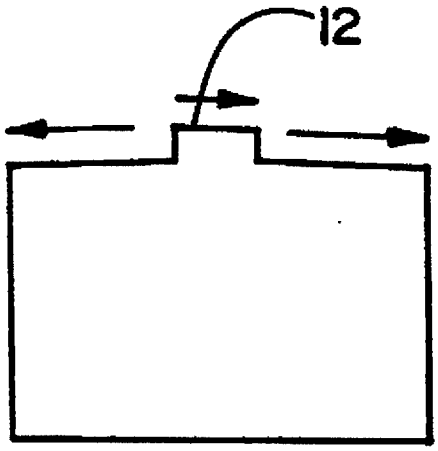
FIG. 3A is a plan view of the foundation block illustrated in FIG. 3.
Figure 3:
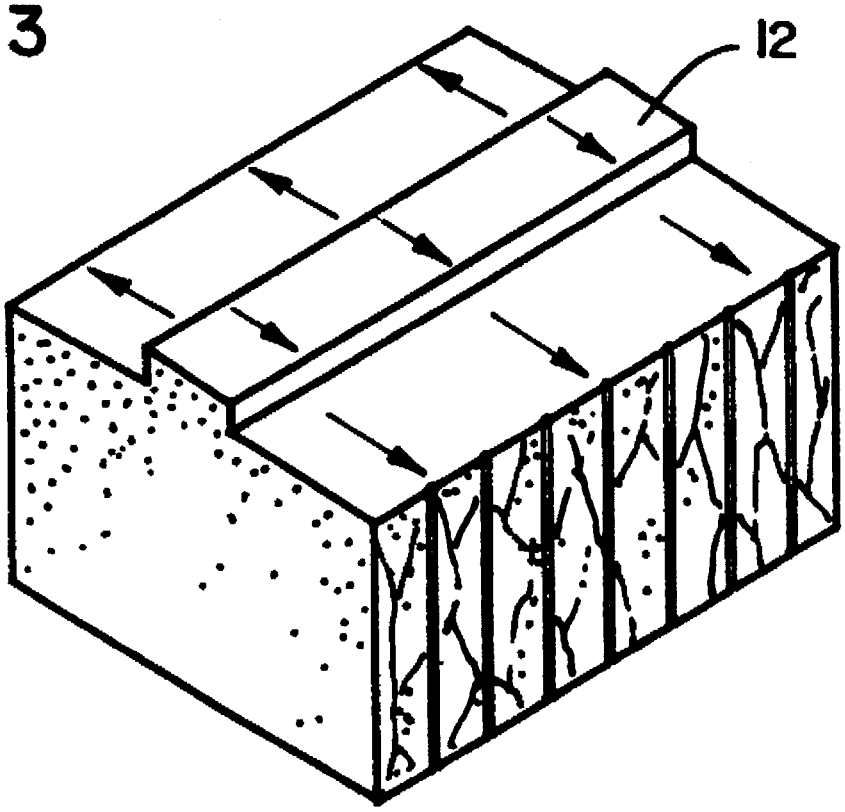
FIG. 3 is a perspective view of a foundation block of the present invention.

With reference to FIGS. 1 and 2, the construction of the present invention includes a granite wall 10 which includes block sections 11, foundation sections 13, and top blocks 18. Each of these include mating sections formed by flanges 12 and recesses 14. The wall is constructed by interlocking the flanges 12 into recesses 14, as illustrated in FIGS. 1 and 2. The interlocking flange construction of the present invention eliminates gaps in wall 10, thereby preventing the blocks from separating and inhibiting and attenuating the gamma radiation. The interlocking flange construction provides structural advantages not necessary in prior granite walls. This additional structural integrity assists in resistance to attack and sabotage. The interlocking flange construction of the preferred embodiment also secures the blocks in place in the event of a seismic load (earthquake). Because the construction of the preferred embodiment does not use mortar or bonding agents, the blocks are allowed to absorb the energy of an earthquake without being ridged and breaking. After an earthquake, the blocks merely settle back into their original position by the guiding force of the interlocking flange.

Figure 4A:
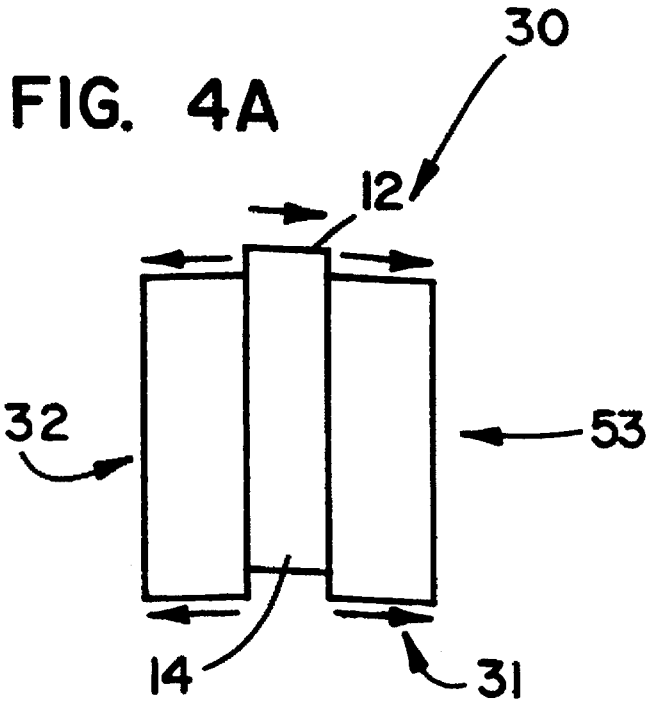
FIG. 4A is a top view of the block section of FIG. 4.
Figure 4:
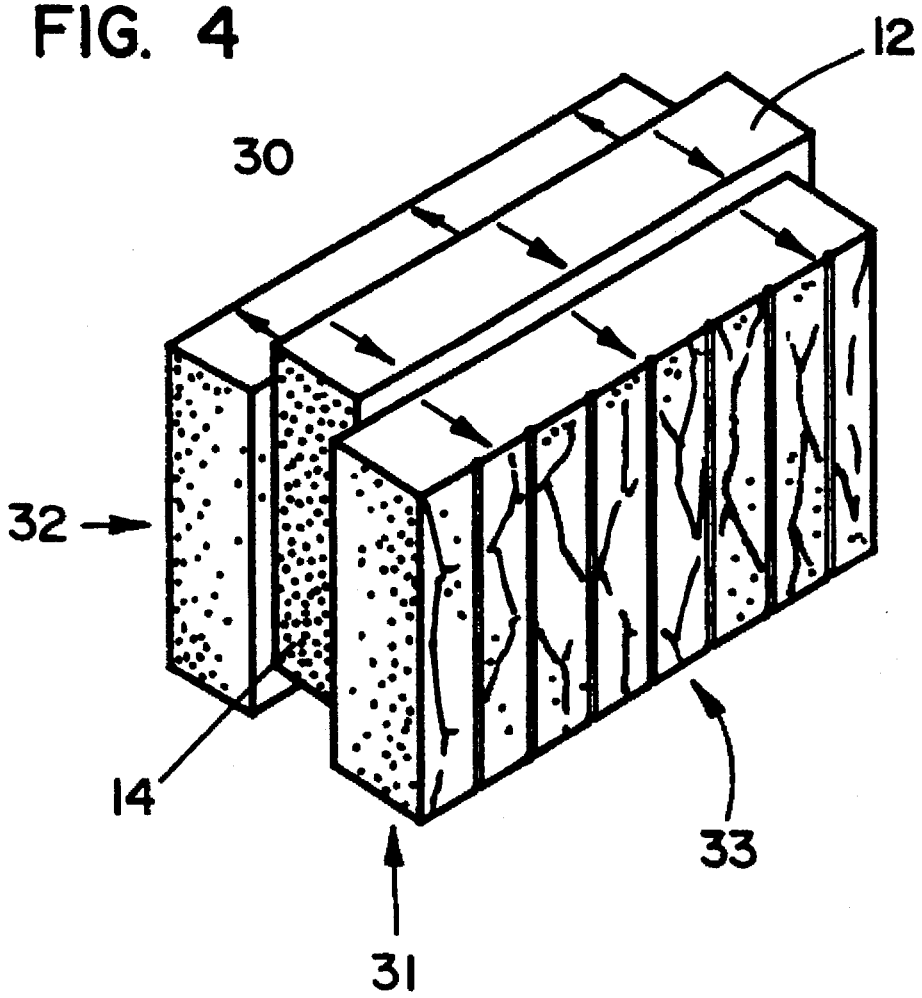
FIG. 4 is a perspective view of a block section of the present invention.
Figure 5A:
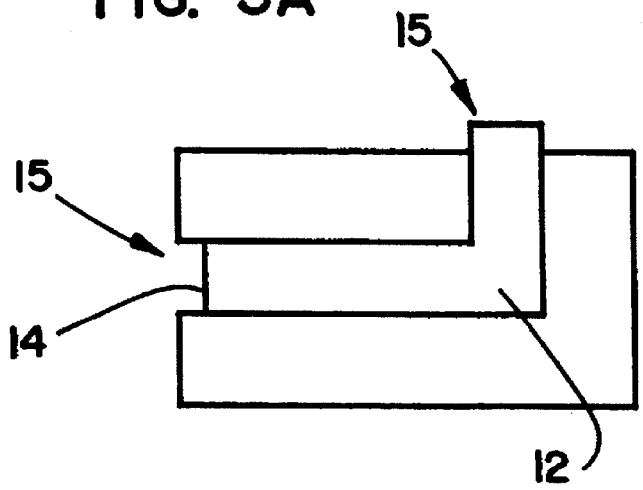
FIG. 5A is a top view of the corner block section of FIG. 5.
Figure 5:
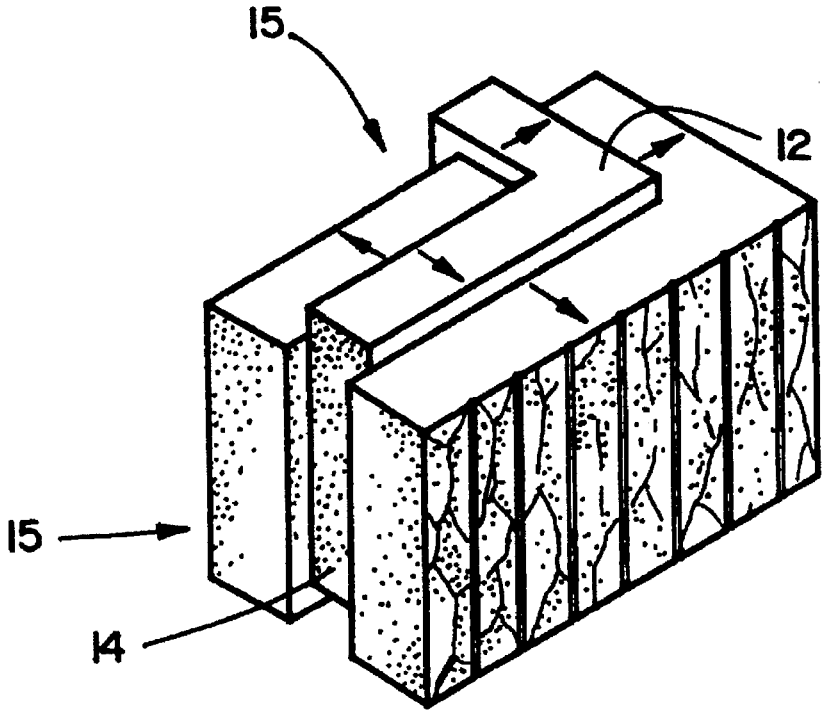
FIG. 5 is a perspective view of a corner block section of the present invention.

As illustrated in FIGS. 4 and 4A, blocks 11 forming wall 10 include a top surface 30, an opposing bottom surface 31 and two opposing side surfaces 32 and 33, respectively. As stated above, and as illustrated in FIGS. 4A and 5A, the top and bottom surfaces 30 and 31 include cooperating flanges 12 and recesses 14 as do the opposing side walls 32 and 33 of the blocks. As shown in FIGS. 1, 5 and 5A, wall 10 includes angled corner blocks 40 which also include flanges 12 and recesses 14 similar to block 11. Corner blocks 40 also include cooperating flanges and recesses on side surfaces 42 and 44, as best illustrated in FIG. 5 and 5A.

The flange and recess construction of the present invention prevents blocks 11 from separating and letting radiation pass through. In the first preferred embodiment, and as illustrated by the arrows in FIG. 4A, top and bottom surfaces 30 and 31 of blocks 11 are sloped to deflect any rain water that may be between the blocks. Adjacent top to bottom blocks have complimentary sloped top and bottom surfaces to ensure proper mating. As shown by the arrows in FIGS. 4 and 5, the top surfaces of flanges 12 are also sloped to deflect water. Corner blocks 40 include sloped surfaces in two directions as shown in FIG. 5.

Figure 7:
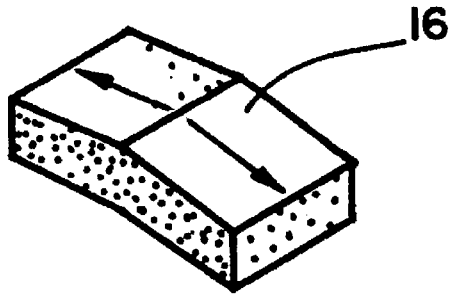
FIG. 7 is a perspective view of a top cap section of the present invention.

As shown in FIGS. 1 and 7, in the preferred embodiment, an angled joint capblock 16 is placed above top block 18. The joint cap block 16 acts as a deflector for rain, thereby preventing deterioration of the granite. By deflecting the rain, water does not build up between the blocks. By preventing penetration of water between the blocks, deterioration due to freeze/thaw cycles is substantially eliminated.

Figure 6A:
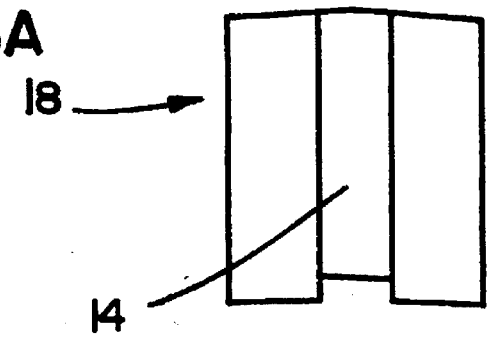
FIG. 6A is a plan view of the top block section of FIG. 6.
Figure 6:
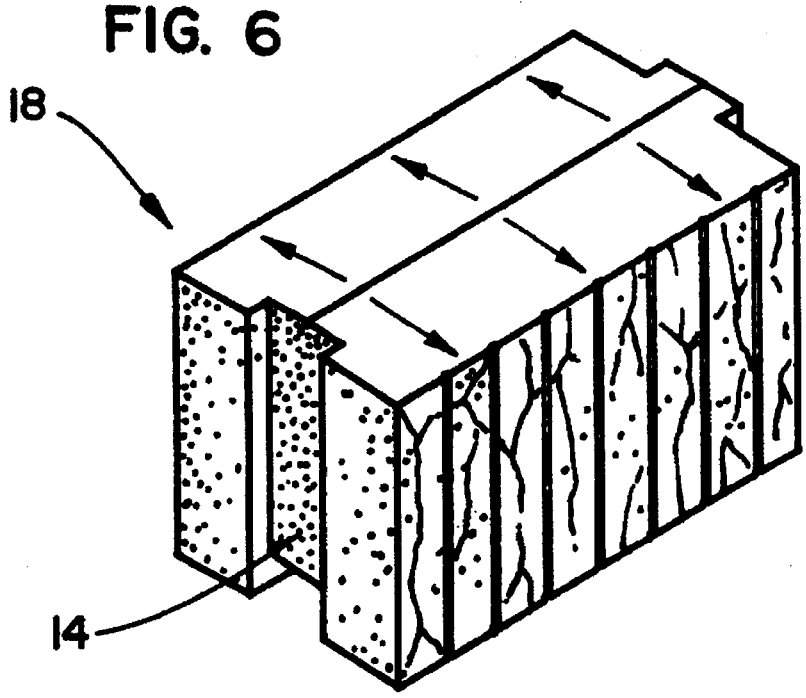
FIG. 6 is a perspective view of a top block section of the present invention.

In the preferred embodiment and as best illustrated in FIG. 2, cap block 16 is only placed at joints 20 formed between adjacent top blocks 18 which form wall 10. As best illustrated in FIG. 6 and 6A, top blocks 18 will have opposed sloping top surfaces 20 and 21 to deflect rain.

In the first preferred embodiment, top blocks 18 are located at the top of wall 10. Top blocks 18 also include interlocking flanges and recesses. Top block 18 includes a sloped top surface to deflect rain and a sloped bottom surface complimentary to the sloped top surface of block 11 positioned immediately below it.

Foundation blocks 13 also include a flange 12. As illustrated in FIGS. 1 and 2, foundation blocks 13 are positioned below a ground surface 24. Prior art granite walls have not utilized foundation blocks which include flanges or recesses. Foundation blocks including flanges or recesses provide additional structural strength.

In the first preferred embodiment, foundation blocks 13 include a greater width than those of block sections 11. Having a greater width exposes top sections 26 and 28 of the foundation blocks. In the first preferred embodiment, exposed sections 26 and 28 are sloped away from wall 10 as to deflect rain water away from wall 10.

It is understood that various structures may be used to interlock the granite blocks and the claims are not limited to the particular construction illustrated in the drawings. For example, the flanges may have different cross-sectional shapes or may be oriented differently on the blocks. Additionally, separate granite slats may be used to interconnect the blocks.

The present invention significantly reduces the present concerns regarding the above-ground storage of spent nuclear fuel and dry casks. Because the wall is constructed of granite, it needs little or no maintenance as compared to secondary shielding constructed of steel or concrete. Further, granite provides excellent radiation attenuation properties, thereby protecting the environment surrounding the dry casks. It is to be understood that the present invention is not limited to the specific construction illustrated in the figures but rather is broadly directed to using granite as a radiation attenuation shield.

In the preferred embodiment, other structure is included in addition to the granite wall surrounding dry casks. For example, a chain fence may surround the granite wall or a berm may be erected which surrounds the granite wall. Cameras may also be included which provide further security for the dry casks containing the spent nuclear fuel.

While the foregoing detailed description of the present invention describes the invention of the preferred embodiments, it will be appreciated that it is the intent of the invention to include all modifications and equivalent designs. Accordingly, the scope of the present invention is intended to be limited only by the claims which are appended hereto.

What is claimed is:

1. A method of attenuating nuclear energy emitted from spent nuclear fuel, including the steps of:

providing a source of radiation;

providing a plurality of granite block sections;

forming a wall from the granite block sections which obstructs the source of radiation.

2. A method as in claim 1, wherein the step of providing a plurality of granite block sections further includes providing a plurality of granite foundation blocks and the method further includes supporting the plurality of granite block sections.

3. A secondary radiation attenuation shield for protecting a source of radiation, the source of radiation being positioned on a ground level the secondary attenuation shield comprising:

a plurality of granite foundation blocks, the granite foundation blocks having a top surface, the top surface having a first mating portion, the foundation blocks being positioned partially below the ground level, the foundation blocks positioned to form a wall;

a plurality of block sections having a top and bottom surface, the bottom surface including a second mating portion cooperative in interfacing with the first mating portion of the foundation blocks so that the foundation blocks and the block sections obstruct the source of radiation.

4. A secondary radiation attenuation shield as in claim 3 wherein the first mating portion on the foundation blocks is a upwardly projecting flange and the second mating portion on the bottom surface of the block section is an upwardly projecting recess.

5. A secondary radiation attenuation shield as in claim 3 further comprising a plurality of top block sections each having an top surface and a bottom surface, the bottom surface having a second mating portion and the block sections include a first mating portion on its top surface so that the top blocks and the block sections obstruct the source of radiation.

6. A secondary radiation attenuation shield as in claim 5 further comprising a plurality of cap blocks positioned on the top surface of the top blocks.

7. A secondary radiation attenuation shield as in claim 6 wherein the cap blocks include opposed sloping surfaces operative in deflecting fluid.

8. A secondary radiation attenuation shield as in claim 3 wherein the foundation sections include a pair of opposed side surfaces, each of the side surfaces including a mating portion cooperative in interfacing with a mating portion on a foundation block positioned adjacent thereto.

9. A secondary radiation attenuation shield as in claim 8 wherein the block sections include a pair of opposed side surfaces, each of the side surfaces including a mating portion cooperative in interfacing with a mating potions on a block section positioned adjacent thereto.

10. A secondary radiation attenuation shield as in claim 3 wherein the top and bottom surfaces of the block sections are sloped.

* * * * *

UNITED STATES PATENT AND TRADEMARK OFFICE
CERTIFICATE OF CORRECTION

PATENT NO. : 5,633,508

DATED : May 27, 1997

INVENTOR(S) : Dale J. Schleppenbach

It is certified that error appears in the above-identified patent and that said Letters Patent is hereby corrected as shown below:

On the title page, in the third OTHER PUBLICATIONS, third line, insert --*Concrete Durability*,-- before "1:1-19"; change "1:1-19" to --1:1-9--.

Column 5, line 65, change "berm" to --beam--.

Column 6, line 22, claim 3, insert --,-- after "level".

Column 6, line 42, claim 5, change "an" to --a--.

Column 6, line 61, claim 9, change "potions" to --portion--.

Signed and Sealed this

Fourteenth Day of October, 1997

*Attest:*

*Attesting Officer*

BRUCE LEHMAN

*Commissioner of Patents and Trademarks*